US006428296B1

(12) United States Patent
Elson et al.

(10) Patent No.: US 6,428,296 B1
(45) Date of Patent: Aug. 6, 2002

(54) HORIZONTAL SCROLL COMPRESSOR HAVING AN OIL INJECTION FITTING

(75) Inventors: John P. Elson, Sidney; Brian R. Butler, Centerville, both of OH (US)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 09/776,823

(22) Filed: Feb. 5, 2001

(51) Int. Cl.[7] ..... F01C 1/04; F01C 21/04

(52) U.S. Cl. ..... 418/55.6; 418/58; 418/94; 418/DIG. 1

(58) Field of Search ..... 418/55.6, 58, 94, 418/DIG. 1; 184/6.16

(56) References Cited

U.S. PATENT DOCUMENTS

| | | | | |
|---|---|---|---|---|
| 1,818,430 A | * | 8/1931 | Ricardo | 418/94 |
| 3,777,509 A | | 12/1973 | Muench | 62/470 |
| 3,945,216 A | | 3/1976 | Schibbye | 62/84 |
| 4,112,701 A | | 9/1978 | Schibbye et al. | 62/84 |
| 4,140,337 A | | 2/1979 | Arcella et al. | 285/3 |
| 4,289,334 A | | 9/1981 | Riley | 285/55 |
| 4,312,187 A | | 1/1982 | Myers | 62/84 |
| 4,343,599 A | | 8/1982 | Kousokabe | 418/88 |
| 4,400,020 A | | 8/1983 | Keller | 285/204 |
| 4,449,895 A | | 5/1984 | Kurahayashi | 417/368 |
| 4,456,437 A | | 6/1984 | Kurahayashi et al. | 417/368 |
| 4,470,772 A | | 9/1984 | Gannaway | 417/368 |
| 4,676,075 A | | 6/1987 | Shiibayashi | 62/469 |
| 4,895,498 A | | 1/1990 | Basseggio | 417/426 |
| 5,027,606 A | | 7/1991 | Short | 62/84 |
| 5,040,382 A | | 8/1991 | Abraham | 62/470 |
| 5,110,268 A | | 5/1992 | Sakurai et al. | 418/55.6 |
| 5,112,201 A | | 5/1992 | Tamura et al. | 418/55.6 |
| 5,131,497 A | | 7/1992 | Rogers | 184/1.5 |
| 5,137,437 A | | 8/1992 | Machida et al. | 418/55.1 |
| 5,277,564 A | | 1/1994 | Tamura et al. | 418/55.6 |
| 5,328,340 A | | 7/1994 | Hara et al. | 418/55.1 |
| 5,345,785 A | | 9/1994 | Sekigami et al. | 418/55.6 |
| 5,358,392 A | | 10/1994 | Ukai | 418/55.6 |
| 5,391,066 A | | 2/1995 | Sawai et al. | 418/55.6 |
| 5,466,136 A | | 11/1995 | Yamada et al. | 418/55.6 |
| 5,580,230 A | | 12/1996 | Keifer et al. | 418/55.5 |
| 5,580,233 A | | 12/1996 | Wakana et al. | 418/55.6 |
| 5,634,345 A | | 6/1997 | Alsenz | 62/84 |
| 5,660,539 A | | 8/1997 | Matsunaga et al. | 418/55.6 |
| 5,685,168 A | | 11/1997 | Sada | 62/473 |
| 5,735,139 A | | 4/1998 | Lord et al. | 62/470 |

FOREIGN PATENT DOCUMENTS

| | | | | |
|---|---|---|---|---|
| JP | 5-202872 | * | 8/1993 | 418/55.6 |

* cited by examiner

*Primary Examiner*—John J. Vrablik
(74) *Attorney, Agent, or Firm*—Harness, Dickey & Pierce, P.L.C.

(57) ABSTRACT

A horizontal scroll-type compressor is provided with an oil injection fitting that extends through the compressor shell and communicates lubricating oil to a lubrication passage in the crankshaft for providing lubricant to the compressor and other components. The oil injection fitting is supplied with lubricant from an externally disposed source.

9 Claims, 3 Drawing Sheets

HORIZONTAL SCROLL COMPRESSOR HAVING AN OIL INJECTION FITTING

FIELD OF THE INVENTION

The present invention relates generally to scroll-type machines. More particularly, the present invention relates to a horizontal scroll-type compressor uniquely converted from a vertical compressor by providing an oil injection fitting for providing lubricating oil from an external source to the oil passage in the crankshaft.

BACKGROUND AND SUMMARY OF THE INVENTION

Scroll machines in general, and particularly scroll compressors, are often disposed in a hermetic shell which defines a chamber within which is disposed a working fluid. A partition within the shell often divides the chamber into a discharge pressure zone and a suction pressure zone. In a low-side arrangement, a scroll assembly is located within the suction pressure zone for compressing the working fluid. Generally, these scroll assemblies incorporate a pair of intermeshed spiral wraps, one or both of which are caused to orbit relative to the other so as to define one or more moving chambers which progressively decrease in size as they travel from an outer suction port towards a center discharge port. An electric motor is normally provided which operates to cause this relative orbital movement.

The partition within the shell allows compressed fluid exiting the center discharge port of the scroll assembly to enter the discharge pressure zone within the shell while simultaneously maintaining the integrity between the discharge pressure zone and the suction pressure zone. This function of the partition is normally accomplished by a seal which interacts with the partition and with the scroll member defining the center discharge port.

The discharge pressure zone of the hermetic shell is normally provided with a discharge fluid port which communicates with a refrigeration circuit or some other type of fluid circuit. In a closed system, the opposite end of the fluid circuit is connected with the suction pressure zone of the hermetic shell using a suction fluid port extending through the shell into the suction pressure zone. Thus, the scroll machine receives the working fluid from the suction pressure zone of the hermetic shell, compresses the working fluid in the one or more moving chambers defined by the scroll assembly, and then discharges the compressed working fluid into the discharge pressure zone of the compressor. The compressed working fluid is directed through the discharge port through the fluid circuit and returns to the suction pressure zone of the hermetic shell through the suction port.

Typically, scroll-type compressors have been designed as either a vertical or a horizontal scroll compressor. A primary difference between the vertical and horizontal scroll compressor designs stems from the fact that the lubrication sump and delivery systems have needed to be specifically adapted for a vertical or horizontal configuration. The present invention resides in the discovery that a typical vertical-type scroll compressor can be modified to be a horizontal-type scroll compressor by providing a unique oil injection fitting for delivering oil to the existing lubricant passage in the crank shaft of the compressor system from an external oil source.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
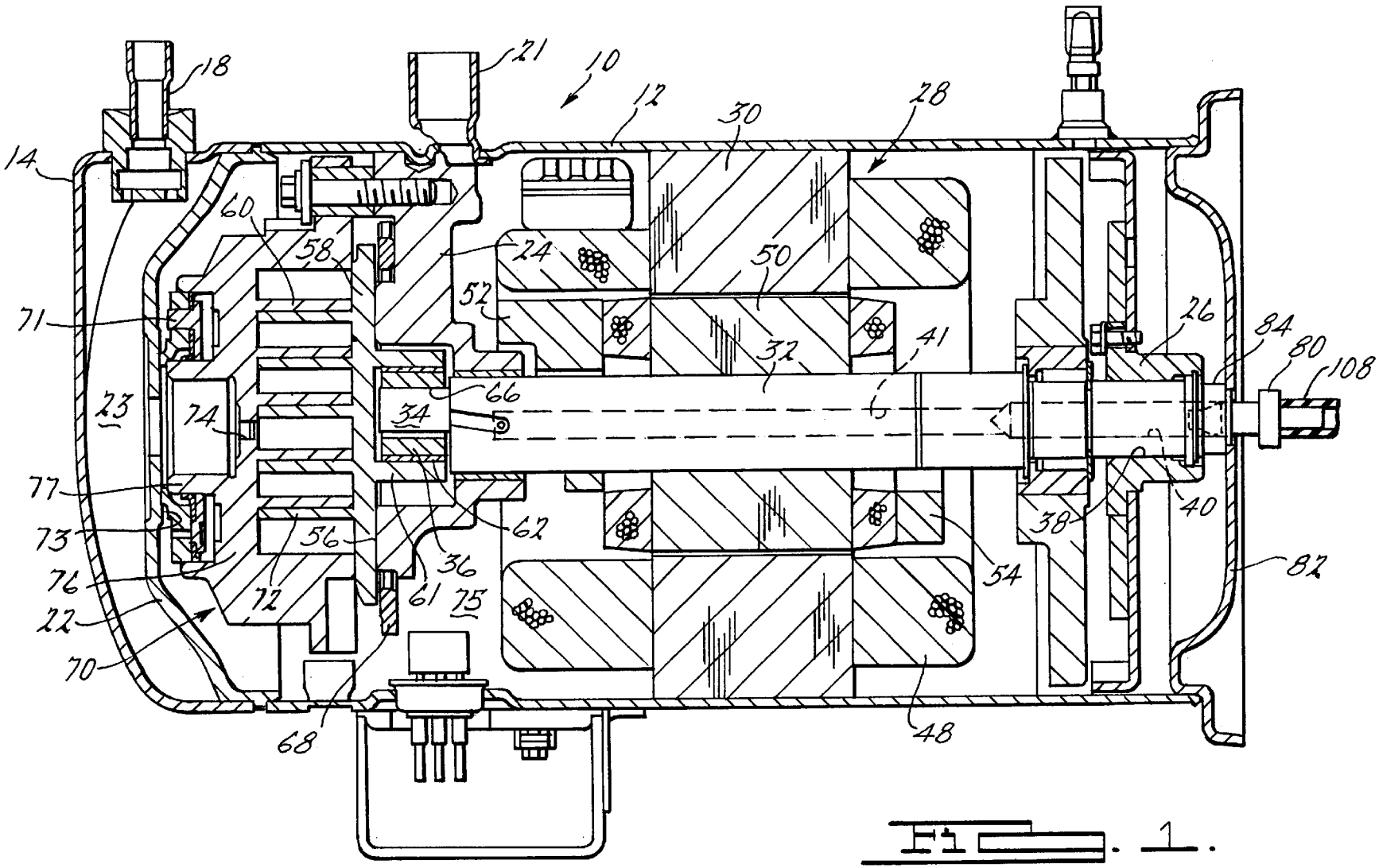
FIG. 1 is a vertical sectional view through the center of a horizontal scroll compressor which incorporates an oil injection fitting in accordance with the present invention.

While the present invention is suitable for incorporation with many different types of scroll machines, for exemplary purposes, it will be described herein incorporated in a scroll compressor of the general structure illustrated in FIG. 1 (the vertical-type compressor shown prior to conversion to a horizontal compressor is a ZB45 compressor commercially available from Copeland Corporation, Sidney, Ohio.) Referring now to the drawings, and in particular to FIG. 1, a compressor 10 is shown which comprises a generally cylindrical hermetic shell 12 having welded at one end thereof a cap 14. Cap 14 is provided with a discharge fitting 18 which may have the usual discharge valve therein. Other major elements affixed to the shell include an inlet fitting 21, a transversely extending partition 22 which is welded about its periphery at the same point that cap 14 is welded to cylindrical shell 12. A discharge chamber 23 is defined by cap 14 and partition 22.

A main bearing housing 24 and a second bearing housing 26 having a plurality of radially outwardly extending legs are each secured to the cylindrical shell 12. A motor 28 which includes a stator 30 is supported within the cylindrical shell 12 between main bearing housing 24 and second bearing housing 26. A crank shaft 32 having an eccentric crank pin 34 at one end thereof is rotatably journaled in a bearing 36 in main bearing housing 24 and a second bearing 38 in second bearing housing 26.

Crank shaft 32 has, at a second end, a relatively large diameter concentric bore 40 which communicates with a radially outwardly smaller diameter bore 41 extending therefrom to the first end of crankshaft 32.

Crank shaft 32 is rotatably driven by electric motor 28 including rotor 50 and stator windings 48 passing therethrough. The rotor 50 is press fitted on crank shaft 32 and includes first and second counterweights 52 and 54, respectively.

A first surface of the main bearing housing 24 is provided with a flat thrust bearing surface 56 against which is disposed an orbiting scroll 58 having the usual spiral vane or wrap 60 on a first surface thereof. Projecting from the second surface of orbiting scroll 58 is a cylindrical hub 61 having a journal bearing 62 therein in which is rotatably disposed a drive bushing 36 having an inner bore 66 in which crank pin 34 is drivingly disposed. Crank pin 34 has a flat on one surface which drivingly engages a flat surface (not shown) formed in a portion of bore 66 to provide a radially compliant driving arrangement, such as shown in assignee's U.S. Pat. No. 4,877,382, the disclosure of which is hereby incorporated herein by reference.

An oldham coupling 68 is disposed between orbiting scroll 58 and bearing housing 24. Oldham coupling 68 is keyed to orbiting scroll 58 and a non-orbiting scroll 70 to prevent rotational movement of orbiting scroll member 58. Oldham coupling 68 is preferably of the type disclosed in assignee's U.S. Pat. No. 5,320,506, the disclosure of which is hereby incorporated herein by reference. A floating seal 71 is supported by the non-orbiting scroll 70 and engages a seat portion 73 mounted to the partition 22 for sealingly dividing the intake and discharge chambers 75 and 23, respectively.

Non-orbiting scroll member 70 is provided having a wrap 72 positioned in meshing engagement with wrap 60 of orbiting scroll 58. Non-orbiting scroll 70 has a centrally disposed discharge passage 74 defined by a base plate portion 76. Non-orbiting scroll 70 also includes an annular hub portion 77 which surrounds the discharge passage 74. A dynamic discharge valve or reed valve can be provided in the discharge passage 74.

Figure 2:
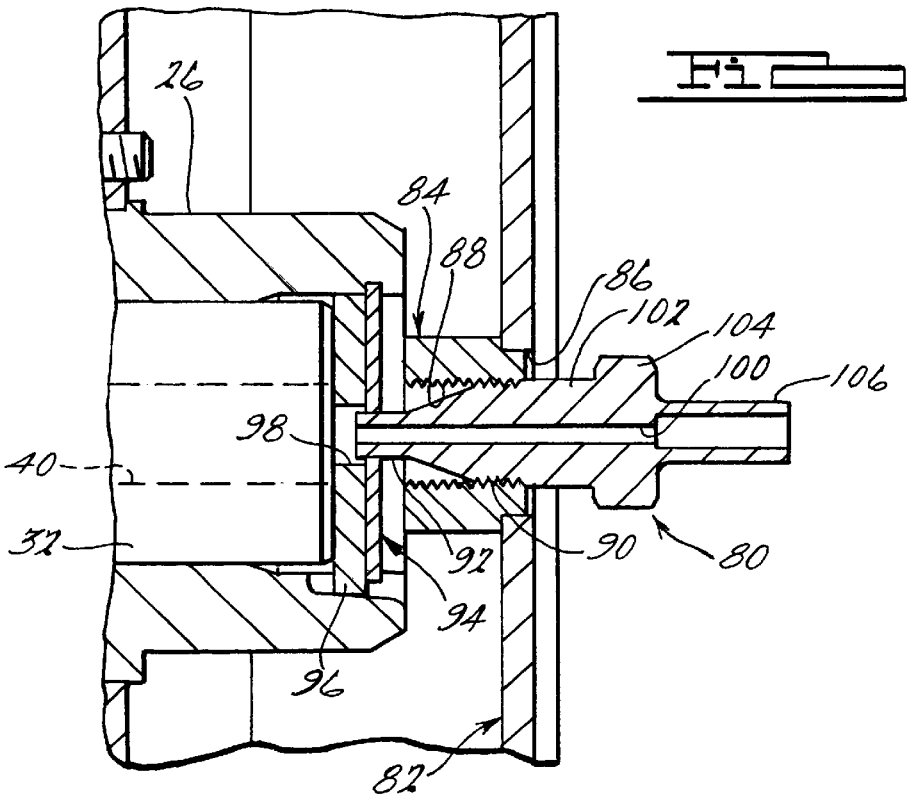
FIG. 2 is a detailed cross-sectional view of the oil injection fitting in accordance with the present invention.

An oil injection fitting 80, as best shown in FIG. 2, is provided through the bottom cap 82 which is connected to the shell 12. The oil injection fitting 80 is threadedly connected to a fitting;.84 which is welded within an opening 86 provided in the bottom cap 82. The fitting 84 includes an internally threaded portion 88 which is threadedly engaged by an externally threaded portion 90 provided at one end of the oil injection fitting 80. A nipple portion 92 extends from the externally threaded portion 90 of the oil injection fitting 80. The nipple portion 92 extends within an opening provided in a snap ring 94 which is disposed in the lower bearing 26. The snap ring 94 holds a disk member 96 in contact with the lower end of the crankshaft 32. Disk member 96 includes a hole 98 which receives, with a clearance, the end of the nipple portion 92 therein. The oil injection fitting includes an internal oil passage 100 extending longitudinally therethrough which serves as a restriction on the oil flow. The oil injection fitting 80 includes a main body portion 102 which is provided with a tool engaging portion 104 (such as a hex shaped portion which facilitates the insertion and removal of the fitting 80 by a standard wrench). The oil injection fitting 80 further includes a second nipple portion 106 extending from the main body 102 in a direction opposite to the first nipple portion 92. The second nipple portion 106 is adapted to be engaged with a hose or tube 108 which supplies oil to the fitting 80.

Figure 3:
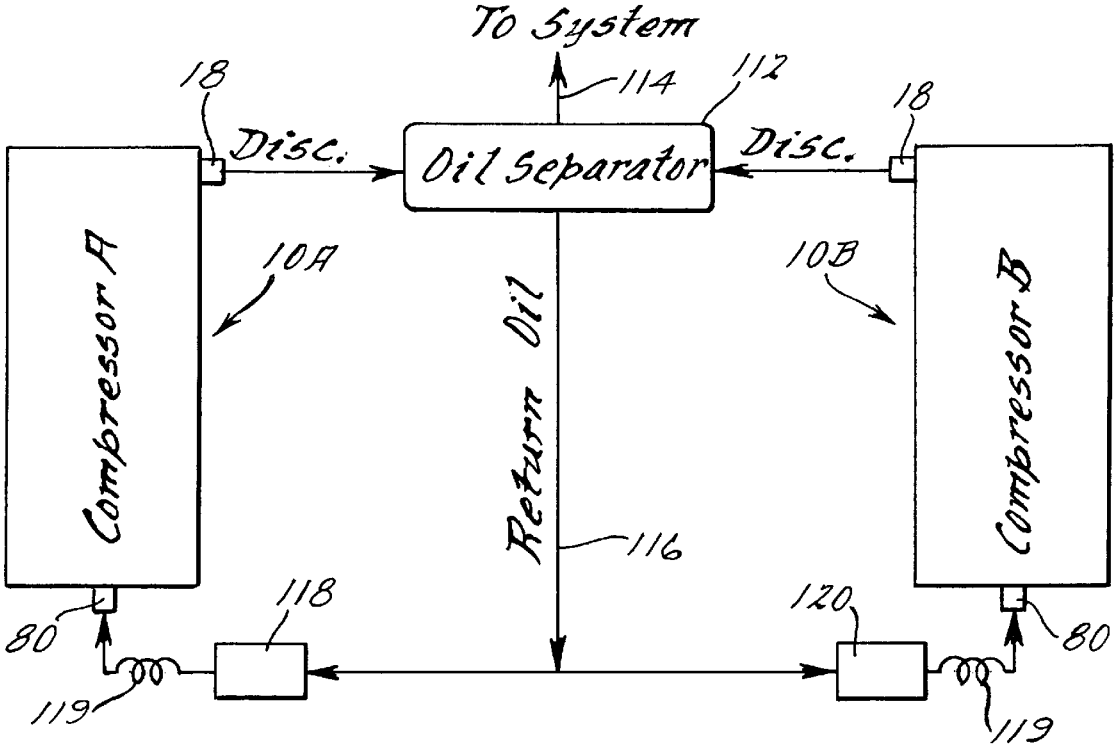
FIG. 3 is a schematic view of a system layout utilizing the horizontal scroll compressor with an oil injection fitting according to the principles of the present invention.

With reference to FIG. 3, a system layout is shown including two compressors 10A, 10B which are both preferably of the type shown in FIG. 1. The system is provided with an oil separator 112 which receives compressed gases from the discharge fittings 18 of compressors 10A, 10B. The oil separator 112 can be of any type known in the art. The oil separator 112 separates the oil from the discharge gases and provides the discharged gases via passage 114 to a desired system. A return oil passage 116 is connected to the oil separator and communicates with a pair of electronic solenoids 118, 120. The electronic solenoids 118, 120 prevent loss of oil to the compressors from the separator after the compressors 10A, 10B are shut down. Capillary tubes 119 are provided to restrict flow to provide oil control to prevent excessive oil flow over the full operating range of the compressore 10A, 10B. The capillary tubes 119 can be used in addition to or as an alternative to the restriction oil passage 100 provided in the oil injection fitting 80. Oil is delivered through the fittings 80 and into the concentric bore 40 provided in the crankshafts 32 of the compressors 10A, 10B. The concentric bore 40 communicates with a radially outward smaller diameter bore 41 extending therefrom to the second end of the crankshaft 32. From the second end of the crankshaft 32, oil is distributed to the bearings and to the scroll members 58, 70.

Figure 4:
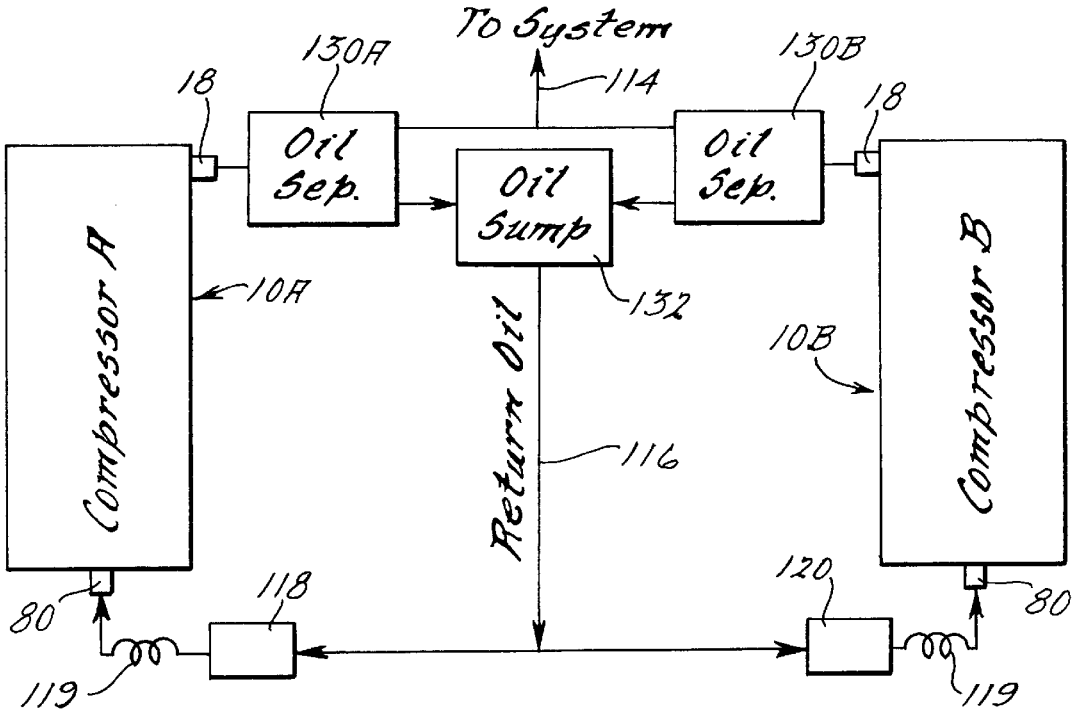
FIG. 4 is a schematic view of a system layout according to a second embodiment of the present invention.

FIG. 4 shows a system layout according to a second embodiment of the present invention. The system layout of FIG. 4 includes first and second compressors 10A, 10B which are provided with their own oil separators 130A, 130B, respectively. Each of the oil separators 130A, 130B are connected to a passage 114 for supplying discharge gases thereto. The oil separators 130A, 130B are connected to an oil sump 132 for providing the separated oil thereto. A return oil passage 116 is connected to the oil sump 132 for returning oil to the first and second compressors 10A, 10B. Electronic solenoids 118, 120 are provided in the respective return oil passages connected to the compressors 10A, 10B. Again, capillary tubes 119 can be provided to restrict the oil flow to the oil injection fittings 80 of the compressors 10A, 10B. The system layout of FIG. 4 allows the use of standard oil separators and can be utilized with an air compressor or a natural gas compressor system.

Figure 5:
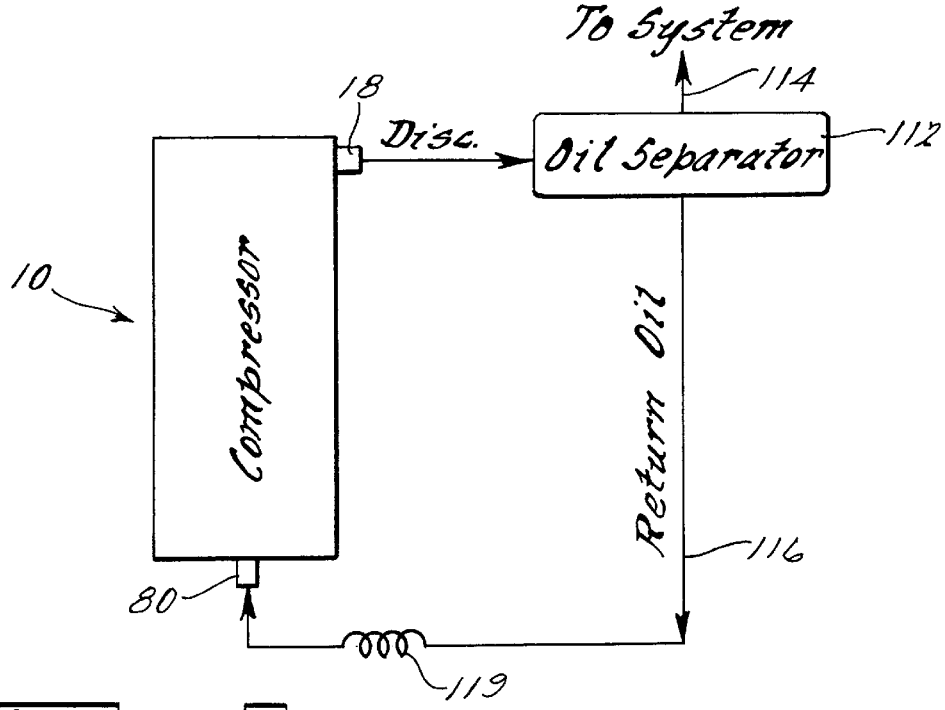
FIG. 5 is a schematic view of a system layout according to a third embodiment of the present invention.

FIG. 5 shows a single compressor system including a compressor 10 having a discharge passage 18 connected to an oil separator 112. An oil return passage 116 is connected to the oil separator 112 for returning oil to the oil injection fitting 80 of the compressor 10. A capillary tube 119 is provided in the oil return passage 116 for restricting oil flow to the compressor. The capillary tube 119 can be used as an alternative or in addition to the restriction passage 100 provided in the oil injection fitting 80.

According to the present invention, a vertical-type compressor can be modified to become a horizontal compressor by adding an oil injection fitting and an external oil separator system. In addition, the modification to the vertical-type compressor to a horizontal compressor has a very low additional cost and has virtually the same performance as the vertical compressor being modified.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A horizontal scroll machine comprising:

a shell;

a first scroll member disposed within said shell, said first scroll member having a port and a first spiral wrap;

a second scroll member disposed within said shell and having a second spiral wrap, said first and second spiral wraps being mutually intermeshed;

a crankshaft drivingly attached to one of said scroll members, said crankshaft including a lubrication passage extending therethrough;

a motor drivingly connected to said crankshaft for causing said one of said scroll members to orbit with respect to the other of said scroll members, whereby said first and second spiral wraps create at least one enclosed space of progressively changing volume between a peripheral zone defined by said scroll members and said port; and an oil injection fitting extending through said shell and communicating with said lubrication passage in said crankshaft;

further comprising a disk member, having a hole therein, said disk member being disposed against an end of said crankshaft such that said hole defines a chamber for receiving lubricant from said fitting;

wherein said disk member is secured in place by a snap ring disposed in a bearing housing, said snap ring having an opening for receiving an end of said oil injection fitting.

2. The scroll machine according to claim 1, further comprising a second fitting attached to an interior side of said end cap and having an internally threaded portion for threaded engagement with an externally threaded portion of said injection oil fitting.

3. The scroll machine according to claim 1 wherein said oil injection fitting includes a reduced diameter passage which restricts oil flow to said lubricant passage in said crankshaft.

4. The scroll machine according to claim 1, wherein said oil injection fitting receives lubrication oil from an oil passage connected to an oil separator.

5. The scroll machine according to claim 4 wherein said oil passage includes a capillary tube for restricting oil flow to said oil injection fitting.

6. A horizontal scroll machine comprising:

a shell;

a first scroll member disposed within said shell, said first scroll member having a port and a first spiral wrap;

a second scroll member disposed within said shell and having a second spiral wrap, said first and second spiral wraps being mutually intermeshed;

a crankshaft drivingly attached to one of said scroll members, said crankshaft including a lubrication passage extending therethrough;

a motor drivingly connected to said crankshaft for causing said one of said scroll members to orbit with respect to the other of said scroll members, whereby said first and second spiral wraps create at least one enclosed space of progressively changing volume between a peripheral zone defined by said scroll members and said port; and an oil injection fitting extending through said shell and communicating with said lubrication passage in said crankshaft;

further comprising a disk member, having a hole therein, said disk member being disposed against an end of said crankshaft such that said hole defines a chamber for receiving lubricant from said fitting;

wherein said fitting includes an end portion received in said hole in said disk member and is provided with a clearance between said end portion and said disk member.

7. A horizontal scroll machine comprising:

a shell;

a first scroll member disposed within said shell, said first scroll member having a port and a first spiral wrap;

a second scroll member disposed within said shell and having a second spiral wrap, said first and second spiral wraps being mutually intermeshed;

a crankshaft drivingly attached to one of said scroll members, said crankshaft including a lubrication passage extending therethrough;

a motor drivingly connected to said crankshaft for causing said one of sais scroll members to orbit with respect to the other of said scroll members, whereby said first and second spiral wraps create at least one enclosed space of progressively changing volume between a peripheral zone defined by said scroll members and said port; and an oil injection fitting extending through said shell and communicating with said lubrication passage in said crankshaft;

wherein said oil injection fitting includes a tool engaging portion and first and second nipple portions extending in opposite directions from said tool engaging portion.

8. The scroll machine according to claim 7, wherein said first nipple portion communicates with said lubrication passage in said crankshaft and said second nipple portion is engaged with an exterior lubricant source.

9. The scroll machine according to claim 8, wherein said first nipple portion is received in a hole in a disk member disposed against an end of said crankshaft with a clearance between said nipple portion and said disk member.

* * * * *

UNITED STATES PATENT AND TRADEMARK OFFICE

CERTIFICATE OF CORRECTION

PATENT NO. : 6,428,296 B1
DATED : August 6, 2002
INVENTOR(S) : John P. Elson and Brian R. Butler It is certified that error appears in the above-identified patent and that said Letters Patent is hereby corrected as shown below:

Column 3,
Line 30, “fitting;.84” should be -- fitting 84 --.

Column 4,
Line 1, “compressore” should be -- compressors --.

Column 6,
Line 23, “sais” should be -- said --.

Signed and Sealed this

Twenty-fifth Day of February, 2003

JAMES E. ROGAN
*Director of the United States Patent and Trademark Office*